US006123786A

United States Patent [19]

Uchiyama et al.

[11] Patent Number: 6,123,786

[45] Date of Patent: Sep. 26, 2000

[54] GOLD MATERIALS FOR ACCESSORIES HARDENED WITH MINOR ALLOYING COMPONENTS

[75] Inventors: Naoki Uchiyama; Toshinori Ishii, both of Hyohgo-ken, Japan

[73] Assignee: Mitsubishi Materials Corporation, Tokyo, Japan

[21] Appl. No.: 08/923,834

[22] Filed: Sep. 4, 1997

Related U.S. Application Data

[63] Continuation of application No. 08/424,276, filed as application No. PCT/JP94/00920, Jun. 7, 1994, abandoned.

[30] Foreign Application Priority Data

Sep. 6, 1993 [JP] Japan ..... 5-245981

[51] Int. Cl.[7] ..... C22C 5/02

[52] U.S. Cl. ..... 148/430; 420/507

[58] Field of Search ..... 420/507, 508, 420/509, 510, 511, 512; 437/209 WB; 148/405, 430

[56] References Cited

U.S. PATENT DOCUMENTS

| | | | |
|---|---|---|---|
| 4,080,485 | 3/1978 | Bonkohara | 420/507 |
| 4,330,329 | 5/1982 | Hayashi et al. | 420/511 |
| 4,775,512 | 10/1988 | Fukui et al. | 420/507 |
| 4,938,923 | 7/1990 | Kujiraoka et al. | 420/507 |

FOREIGN PATENT DOCUMENTS

| | | | |
|---|---|---|---|
| 381994 | 8/1990 | European Pat. Off. | C22C 5/02 |
| 56-088328 | 7/1981 | Japan . | |
| 56-088329 | 7/1981 | Japan . | |
| 62-290836 | 12/1987 | Japan . | |
| 03020425 | 1/1991 | Japan . | |
| 03130337 | 6/1991 | Japan . | |
| 3-257129 | 11/1991 | Japan . | |
| 4-010634 | 1/1992 | Japan . | |
| 4-012543 | 1/1992 | Japan . | |
| 6-264163 | 9/1994 | Japan . | |

*Primary Examiner*—Melvyn Andrews

*Attorney, Agent, or Firm*—McAulay Nissen Goldberg Kiel & Hand, LLP

[57] ABSTRACT

A gold material for accessories comprises a hardened gold alloy composed of pure gold having a purity of 99% or more and from 200 to 2000 ppm, relative to the total weight of the resulting gold alloy, of one or more alloying components selected from Ca, Be, Ge and B, and optionally from 10 to 500 ppm, relative to the same, of one or more other alloying components selected from Mg, Al, Si, Mn, Fe, Co, Ni, Cu, Pd, Ag, In, Sn, Sb, Pb and Bi and/or from 10 to 1000 ppm, relative to the same, of one or more other alloying components selected from rare earth elements including Y.

2 Claims, No Drawings

GOLD MATERIALS FOR ACCESSORIES HARDENED WITH MINOR ALLOYING COMPONENTS

This is a continuation of application Ser. No. 08/424,276, filed Apr. 21,1995, now abandoned which, in turn is a 371 application of PCT/JP94/00920 of Jun. 7, 1994.

TECHNICAL FIELD

The present invention relates to gold materials for accessories which are damaged little by rubbing or scratching, as being highly hard to have a Vickers hardness (Hv) of 100 or more, and which maintain said high hardness independently of time or even after heated by brazing or the like.

BACKGROUND ART

Heretofore, in general, Au alloys having an elevated Hv of 100 or more have been popularly used to produce accessories such as neck chains, brooches, rings, etc. Such Au alloys include, for example, K14 alloys and K18 alloys comprising pure gold having a purity of 99% or more and approximately from 25 to 40% by weight of alloying components such as Ag, Cu and even Ni, Pd, Zn, etc.

On the other hand, it is said ideal that the above-mentioned accessories are made of pure gold in view of their color and high-quality appearance. However, pure gold has Hv of about 32 as its ingot, while having Hv of about 80 as its worked wire. Even though such pure gold is worked to have an elevated hardness, the elevated hardness of the thus-worked pure gold is inevitably lowered not only with the lapse of time but also when heated by brazing or the like. For these reasons, pure gold accessories are always soft and are therefore easily scratched. It is extremely difficult to keep the esthetic value of such pure gold accessories for a long period of time, and the practical application of pure gold accessories is limited to only an extremely narrow range at present.

DESCRIPTION OF THE INVENTION

We, the present inventors have studied, from the above-mentioned viewpoints, so as to elevate the hardness of pure gold accessories without detracting from their high esthetic value mentioned above and, as a result, have found that;

when pure gold having a purity of 99% or more is alloyed with from 200 to 2000 ppm, preferably from 800 to 1800 ppm, more preferably from 1000 to 1600 ppm, relative to the total weight of the resulting gold alloy, of one or more alloying components selected from Ca, Be, Ge and B, then the resulting gold alloy can have an elevated Hv of 100 or more, while still maintaining said elevated hardness independently of time or even after heated by brazing or the like, and in addition, since the content of the above-mentioned alloying components is small, the hardened gold alloy can still maintain the color and the high quality of pure gold itself and therefore can be formed into gold accessories capable of maintaining a high esthetic value comparable to that of pure gold accessories for a long period of time, that;

when said pure gold is alloyed with said alloying component(s) and also from 10 to 500 ppm, preferably from 50 to 400 ppm, more preferably from 100 to 300 ppm, relative to the total weight of the resulting gold alloy, of one or more other alloying components selected from Mg, Al, Si, Mn, Fe, Co, Ni, Cu, Pd, Ag, In, Sn, Sb, Pb and Bi, then the resulting gold alloy can have an elevated mechanical strength, and that;

when said pure gold is alloyed with said alloying component(s) and also from 10 to 1000 ppm, preferably from 100 to 500 ppm, more preferably from 200 to 400 ppm, relative to the total weight of the resulting gold alloy, of one or more other alloying components selected from rare earth elements including Y, then the resulting gold alloy can have much more improved plastic workability such as drawing workability and rolling workability.

The present invention has been attained on the basis of the above-mentioned findings and is characterized in that it provides hardened gold materials for accessories comprising;

pure gold having a purity of 99% or more and from 200 to 2000 ppm, preferably from 800 to 1800 ppm, more preferably from 1000 to 1600 ppm, relative to the total weight of the resulting gold alloy, of one or more alloying components selected from Ca, Be, Ge and B (hereinafter generically referred to as "hardness-improving components"), and optionally, (a) from 10 to 500 ppm, preferably from 50 to 400ppm, more preferably from 100 to 300 ppm, relative to the total weight of the resulting gold alloy, of one or more other alloying components selected from Mg, Al, Si, Mn, Fe, Co, Ni, Cu, Pd, Ag, In, Sn, Sb, Pb and Bi (hereinafter generically referred to as "strength-improving components"), and/or (b) from 10 to 1000 ppm, preferably from 100 to 500 ppm, more preferably from200 to 400 ppm, relative to the total weight of the resulting gold alloy, of one or more other alloying components selected from rare earth elements including Y (hereinafter referred to as "workability-improving components").

In the present invention, pure gold to be alloyed shall have a purity of99% or more. This is because if gold having a purity of less than99% is alloyed according to the present invention, the resulting gold alloy no more has the golden color which pure gold possesses and therefore loses the high-quality appearance of pure gold.

The reason why the content of the hardnessimproving component(s) is defined to fall within the range between200 ppm and 2000 ppm is because, if it is less than200 ppm, it is impossible to elevate the hardness of the resulting gold alloy to have Hv of 100 or more and is also impossible to prevent the thus-elevated hardness of the gold alloy from being lowered with the lapse of time or when the gold alloy is heated. On the other hand, if said content is more than 2000 ppm, the gold alloy can no more have the color and the high-quality appearance of pure gold itself with the result that the esthetic value of the gold alloy is lowered.

The reason why the content of the strength-improving component(s) and that of the workability-improving component(s) are defined to fall within the range between 10 ppm and 500 ppm and within the range between 10 ppm and 1000ppm, respectively, is because, if they are less than 10 ppm, it is impossible to attain the intended effects to improve the mechanical strength and the plastic workability of the gold alloy. On the other hand, if they are more than 500 ppm or 1000 ppm, the color of the gold alloy is noticeably worsened.

BEST MODES OF PRACTICING THE INVENTION

Next, the gold materials for accessories of the present invention are described concretely by means of their examples.

Pure gold having a purity shown in Tables 1 to 6 was melted in an ordinary vacuum melting furnace, to which was/were added alloying component(s) of the amount(s) also shown in Tables 1 to 6. Next, the resulting gold alloy was cast into a columnar ingot having a diameter of 20 mm and a length of 100 mm, and test pieces were cut out of the ingot. The hardness (micro-Vickers hardness under 100 gr) of the test piece was measured. The test piece was chamfered and then introduced into a single-head drawing machine where it was repeatedly drawn by 20 passes to be formed into a wire having a diameter of 0.5 mm. In this way, gold alloy wire samples, Nos. 1 to 55 of the present invention were prepared. As a control, a pure gold wire sample was prepared in the same manner as above, except that no alloying component was added.

The hardness (micro-Vickers hardness under 100 gr) of each of these wire samples was measured immediately after having been drawn and after having been stored for 6 months. In addition, each wire sample was, immediately after having been drawn, heated at 450° C. for 30 minutes and then cooled under the conditions corresponding to those for ordinary brazing, for example, using a soldering alloy of Au:3 wt. %-Si having a melting point of 370° C. or a soldering alloy of Au:12 wt. %-Ge having a melting point of 350° C. The hardness of each of the thus heat-treated wire samples was also measured in the same manner as above. In order to evaluate the mechanical strength of each wire sample, the tensile strength of each wire sample was measured immediately after having been drawn. The results obtained are shown in Tables 7 to 10.

TABLE 1

| Samples | Purity of Pure gold (%) | Content(s) of Alloying Component(s) (ppm) | | |
|---|---|---|---|---|
| | | Hardness-improving Component(s) | Strength-improving Component(s) | Workability-improving Component(s) |
| Gold Alloy Wire Samples of the invention for Accessories | | | | |
| 1 | 99.69 | Ca: 404 | — | — |
| 2 | 99.84 | Be: 841 | — | — |
| 3 | 99.38 | Ge: 865 | — | — |
| 4 | 99.85 | B: 391 | — | — |
| 5 | 99.56 | Ca: 573, Be: 798 | — | — |
| 6 | 99.35 | Be: 68, Ge: 584 | — | — |
| 7 | 99.37 | Ge: 92, B: 420 | — | — |
| 8 | 99.94 | Ca: 508, Be: 73, Ge: 376 | — | — |
| 9 | 99.67 | Be: 876, Ge: 599, B: 504 | — | — |
| 10 | 99.39 | Ca: 388, Be: 430, Ge: 18, B: 359 | — | — |

TABLE 2

| Samples | Purity of Pure gold (%) | Content(s) of Alloying Component(s) (ppm) | | |
|---|---|---|---|---|
| | | Hardness-improving Component(s) | Strength-improving Component(s) | Workability-improving Component(s) |
| Gold Alloy Wire Samples of the invention for Accessories | | | | |
| 11 | 99.61 | Ca: 481 | — | Y: 699 |
| 12 | 99.90 | Be: 1535 | — | La: 615 |
| 13 | 99.86 | Ge: 231 | — | Ce: 740 |
| 14 | 99.45 | B: 629 | — | Pr: 810 |
| 15 | 99.95 | Ca: 461, Be: 157 | — | Nd: 161 |
| 16 | 99.64 | Be: 845, Ge: 776 | — | Pm: 26 |
| 17 | 99.72 | Ge: 615, B: 774 | — | Sm: 899 |
| 18 | 99.87 | Ca: 298, Ge: 335 | — | Eu: 543 |
| 19 | 99.52 | Be: 539, B: 1001 | — | Gd: 921 |
| 20 | 99.40 | Ge: 241, B: 56 | — | Tb: 559 |

TABLE 3

| Samples | Purity of Pure gold (%) | Content(s) of Alloying Component(s) (ppm) | | |
|---|---|---|---|---|
| | | Hardness-improving Component(s) | Strength-improving Component(s) | Workability-improving Component(s) |
| Gold Alloy Wire Samples of the invention for Accessories | | | | |
| 21 | 99.43 | Ca: 599, Ge: 388, B: 27 | — | Dy: 17 |
| 22 | 99.75 | Be: 269 | — | Y: 727, La: 29 |
| 23 | 99.77 | Ge: 639 | — | La: 195, Ce: 474 |
| 24 | 99.43 | B: 1055 | — | Pr: 324, Nd: 19 |

TABLE 3-continued

| Samples | Purity of Pure gold (%) | Content(s) of Alloying Component(s) (ppm) Hardness-improving Component(s) | Strength-improving Component(s) | Workability-improving Component(s) |
|---|---|---|---|---|
| 25 | 99.43 | Ca: 692 | — | Pm: 668, Sm: 83 |
| 26 | 99.67 | Ca: 49, Be: 399 | — | Eu: 682, Gd: 49 |
| 27 | 99.95 | Ge: 503, B: 231 | — | Y: 219, Tb: 283, Dy: 111 |
| 28 | 99.44 | Be: 469, Ge: 33 | — | La: 84, Pr: 578, Pm: 327 |
| 29 | 99.86 | Ge: 899 | — | Eu: 224, Gd: 198, Tb: 253 |
| 30 | 99.73 | Be: 579 | — | Ce: 58, Pr: 268, Nd: 123, Pm: 59 |

TABLE 4

| Samples | Purity of Pure gold (%) | Content(s) of Alloying Component(s) (ppm) Hardness-improving Component(s) | Strength-improving Component(s) | Workability-improving Component(s) |
|---|---|---|---|---|
| Gold Alloy Wire Samples of the invention for Accessories | | | | |
| 31 | 99.34 | Ca: 776 | Mg: 225 | — |
| 32 | 99.54 | Be: 212 | Al: 273 | — |
| 33 | 99.52 | Ge: 619 | Si: 197 | — |
| 34 | 99.46 | B: 918 | Mn: 241 | — |
| 35 | 99.65 | Ca: 582, Be: 18 | Fe: 66 | — |
| 36 | 99.37 | Ge: 180, B: 360 | Co: 91 | — |
| 37 | 99.83 | Ca: 199, Be: 203, Ge: 15 | Ni: 247 | — |
| 38 | 99.46 | Ca: 84, Be: 51, Ge: 910, B: 483 | Cu: 220 | — |
| 39 | 99.57 | Ca: 934 | Pd: 196 | Y: 102 |
| 40 | 99.92 | Be: 890 | Ag: 62 | Ce: 620 |

TABLE 5

| Samples | Purity of Pure gold (%) | Content(s) of Alloying Component(s) (ppm) Hardness-improving Component(s) | Strength-improving Component(s) | Workability-improving Component(s) |
|---|---|---|---|---|
| Gold Alloy Wire Samples of the invention for Accessories | | | | |
| 41 | 99.97 | Ge: 704 | In: 181 | Nd: 989 |
| 42 | 99.44 | B: 959 | Sn: 308 | Sm: 237 |
| 43 | 99.83 | Ca: 876, Ge: 890 | Sb: 148 | Gd: 731 |
| 44 | 99.87 | Be: 513, B: 895 | Pb: 97 | Dy: 402 |
| 45 | 99.91 | Be: 157, Ge: 608 | Bi: 231 | Y: 389, Ce: 520 |
| 46 | 99.85 | Ca: 527 | Mg: 237, Al: 121 | Pr: 394 |
| 47 | 99.84 | Be: 584 | Si: 253, Mn: 11 | Nd: 587, Sm: 105 |
| 48 | 99.96 | Ge: 1289 | Fe: 47, Co: 284 | Pr: 432, Pm: 210, Gd: 13 |

TABLE 6

| Samples | Purity of Pure gold (%) | Content(s) of Alloying Component(s) (ppm) Hardness-improving Component(s) | Strength-improving Component(s) | Workability-improving Component(s) |
|---|---|---|---|---|
| Gold Alloy Wire Samples of the invention for Accessories | | | | |
| 49 | 99.91 | B: 489 | Ni: 67, Cu: 181 | La: 56, Nd: 99, Eu: 123, Tb: 59 |
| 50 | 99.86 | Ca: 235, B: 52 | Pd: 29, Ag: 144, In: 69 | Ce: 144, Pm: 6, Gd: 19 |
| 51 | 99.58 | Ca: 452, Ge: 326 | Sn: 222, Sb: 117, Pb: 26 | Pr: 45, Eu: 399 |
| 52 | 99.91 | Be: 669, B: 268 | Co: 188, Ag: 59, Bi: 263 | Nd: 33 |
| 53 | 99.53 | Ca: 456, Ge: 364 | Al: 165, Mn: 26, Co: 79, Cu: 110 | Ce: 59, Sm: 628 |
| 54 | 99.40 | Be: 1698 | Ni: 120, Pd: 33, In: 56, Sn: 139 | Dy: 23 |

TABLE 6-continued

| Samples | Purity of Pure gold (%) | Content(s) of Alloying Component(s) (ppm) | | |
|---|---|---|---|---|
| | | Hardness-improving Component(s) | Strength-improving Component(s) | Workability-improving Component(s) |
| 55 | 99.72 | Ca: 523, Ge: 698 | Mg: 87, Si: 59, Fe: 129, Cu: 44, Ag: 168 | Ce: 19 |
| Pure Gold Wire Sample for Accessories | 99.99 | — | — | — |

TABLE 7

| Samples | Hardness (Hv) | | | | Tensile Strength ($kg/mm^2$) |
|---|---|---|---|---|---|
| | Ingot | Immediately After Being Drawn | After Being Stored for 6 Months | Immediately After Being Heated | |
| Gold Alloy Wire Samples of the Invention for Accessories | | | | | |
| 1 | 53 | 105 | 104 | 104 | 37.7 |
| 2 | 59 | 110 | 110 | 109 | 41.9 |
| 3 | 57 | 109 | 108 | 107 | 39.2 |
| 4 | 51 | 104 | 104 | 104 | 37.8 |
| 5 | 62 | 119 | 119 | 118 | 41.8 |
| 6 | 61 | 117 | 117 | 116 | 40.8 |
| 7 | 58 | 109 | 109 | 109 | 40.0 |
| 8 | 63 | 121 | 120 | 120 | 42.6 |
| 9 | 66 | 123 | 123 | 119 | 47.7 |
| 10 | 63 | 121 | 121 | 119 | 45.8 |
| 11 | 69 | 137 | 137 | 136 | 46.2 |
| 12 | 73 | 141 | 141 | 138 | 48.9 |
| 13 | 68 | 128 | 128 | 126 | 47.1 |
| 14 | 62 | 120 | 120 | 117 | 42.9 |

TABLE 8

| Samples | Hardness (Hv) | | | | Tensile Strength ($kg/mm^2$) |
|---|---|---|---|---|---|
| | Ingot | Immediately After Being Drawn | After Being Stored for 6 Months | Immediately After Being Heated | |
| Gold Alloy Wire Samples of the Invention for Accessories | | | | | |
| 15 | 57 | 113 | 113 | 112 | 41.7 |
| 16 | 64 | 128 | 128 | 125 | 48.8 |
| 17 | 72 | 141 | 141 | 138 | 49.9 |
| 18 | 66 | 124 | 124 | 122 | 48.6 |
| 19 | 71 | 143 | 143 | 142 | 51.2 |
| 20 | 57 | 115 | 115 | 113 | 44.3 |
| 21 | 65 | 131 | 131 | 128 | 43.8 |
| 22 | 65 | 132 | 132 | 127 | 46.7 |
| 23 | 58 | 114 | 114 | 112 | 44.8 |
| 24 | 62 | 123 | 122 | 123 | 49.0 |
| 25 | 55 | 111 | 111 | 111 | 42.5 |
| 26 | 59 | 119 | 119 | 115 | 45.8 |
| 27 | 63 | 123 | 123 | 122 | 46.8 |
| 28 | 68 | 131 | 131 | 128 | 49.3 |

TABLE 9

| Samples | Hardness (Hv) Ingot | Immediately After Being Drawn | After Being Stored for 6 Months | Immediately After Being Heated | Tensile Strength ($kg/mm^2$) |
|---|---|---|---|---|---|
| Gold Alloy Wire Samples of the Invention for Accessories | | | | | |
| 29 | 65 | 130 | 130 | 130 | 50.3 |
| 30 | 63 | 125 | 125 | 123 | 47.6 |
| 31 | 65 | 126 | 126 | 124 | 52.3 |
| 32 | 67 | 135 | 135 | 134 | 54.8 |
| 33 | 59 | 112 | 112 | 110 | 53.5 |
| 34 | 59 | 118 | 118 | 115 | 53.2 |
| 35 | 62 | 121 | 121 | 120 | 53.8 |
| 36 | 66 | 131 | 131 | 129 | 53.1 |
| 37 | 59 | 119 | 119 | 118 | 52.8 |
| 38 | 66 | 131 | 132 | 128 | 55.8 |
| 39 | 64 | 129 | 129 | 127 | 55.7 |
| 40 | 66 | 131 | 131 | 127 | 55.4 |
| 41 | 62 | 129 | 129 | 127 | 61.3 |
| 42 | 60 | 121 | 121 | 119 | 56.8 |

TABLE 10

| Samples | Hardness (Hv) Ingot | Immediately After Being Drawn | After Being Stored for 6 Months | Immediately After Being Heated | Tensile Strength ($kg/mm^2$) |
|---|---|---|---|---|---|
| Gold Alloy Wire Samples of the Invention for Accessories | | | | | |
| 43 | 75 | 143 | 143 | 143 | 62.5 |
| 44 | 68 | 139 | 139 | 137 | 58.3 |
| 45 | 61 | 126 | 126 | 124 | 52.7 |
| 46 | 66 | 129 | 129 | 127 | 53.8 |
| 47 | 63 | 130 | 130 | 128 | 55.6 |
| 48 | 72 | 140 | 140 | 138 | 56.9 |
| 49 | 59 | 123 | 123 | 121 | 54.8 |
| 50 | 61 | 123 | 123 | 120 | 58.8 |
| 51 | 64 | 131 | 131 | 130 | 59.3 |
| 52 | 61 | 124 | 124 | 123 | 60.1 |
| 53 | 63 | 127 | 127 | 125 | 57.7 |
| 54 | 75 | 142 | 142 | 142 | 62.3 |
| 55 | 62 | 127 | 127 | 127 | 60.4 |
| Pure Gold Wire Sample for Accessories | 32 | 80 | 35 | 30 | 31.6 |

From the results shown in Tables 1 to 10, it is known that all the gold alloy wire samples of the present invention, Nos. 1 to 55 of always had a high hardness, namely, Hv of 100 or more even after being stored or even after being heated, while the hardness of the pure gold wire sample having Hv of less than 100 was noticeably lowered after being stored and after being heated. It is therefore obvious that the stability of the hardness of the gold alloy wire samples of the present invention is significantly higher than that of the pure gold wire sample and that the mechanical strength of the former containing strength-improving component(s) was extremely improved.

As mentioned hereinabove, the gold materials for accessories of the present invention are hardly scratched as stably and always having an elevated Hv of 100 or more even after being stored or heated. Moreover, since the content of the alloying components in the gold materials of the present invention is small, the gold materials have, in addition to said high hardness, an esthetic value comparable to the excellent esthetic value of pure gold and maintain said esthetic value for a long period of time due to their high hardness. The gold materials for accessories of the present invention thus have practically useful characteristics.

We claim:

1. A hardened gold alloy for accessories consisting of from more than 200 to 2000 ppm of Ca based on total weight of the alloy and from 10 to 1000 ppm based on the total weight of the alloy of an element selected from the group consisting of rare earth elements, Y, and combinations thereof, with the balance being gold and having a Vickers hardness of 100 or more.

2. A hardened gold material for accessories consisting of from 700 to 800 ppm of Ca and about 50 ppm of La with the balance being gold and having a Vickers hardness of 100 or more.

* * * * *